US005890612A

United States Patent [19]

Coppi

[11] Patent Number: 5,890,612

[45] Date of Patent: Apr. 6, 1999

[54] COLLAPSIBLE AIRCRAFT CONTAINER

[75] Inventor: Paolo Coppi, Fabriano, Italy

[73] Assignee: European Aviation Products—S.R.L., Monsano, Italy

[21] Appl. No.: 745,417

[22] Filed: Nov. 12, 1996

[30] Foreign Application Priority Data

Jul. 30, 1996 [IT] Italy ..... AN960020 U

[51] Int. Cl.[6] ..... B65D 6/18

[52] U.S. Cl. ..... 220/7; 220/6; 220/1.5; 220/9.2; 220/9.4; 220/531; 206/600

[58] Field of Search ..... 220/1.5, 6, 7, 9.1, 220/9.2, 9.3, 666, 668, 529, 531, 4.28, 9.4; 206/600, 386

[56] References Cited

U.S. PATENT DOCUMENTS

| | | | |
|---|---|---|---|
| 2,623,565 | 12/1952 | Unthank | 220/666 |
| 2,653,826 | 9/1953 | Yen-Shen Lu | 220/9.2 |
| 2,891,803 | 6/1959 | Mintz | 220/6 |
| 3,502,205 | 3/1970 | Milton | 220/6 |
| 3,645,596 | 2/1972 | Russell-French | 220/1.5 |
| 3,860,138 | 1/1975 | Lovich et al. | 220/1.5 |
| 4,574,968 | 3/1986 | Mittelmann | 220/668 |
| 4,684,034 | 8/1987 | Ono et al. | 220/7 |
| 4,860,912 | 8/1989 | Kupersmit . | |
| 5,217,132 | 6/1993 | Looker | 220/1.5 |
| 5,279,437 | 1/1994 | Kupersmit . | |

FOREIGN PATENT DOCUMENTS

| | | | |
|---|---|---|---|
| 2256078 | 7/1975 | France . | |
| 2026985 | 2/1980 | United Kingdom . | |
| 2265602 | 10/1993 | United Kingdom | 206/600 |
| 9002084 | 3/1990 | WIPO . | |

*Primary Examiner*—Stephen J. Castellano
*Attorney, Agent, or Firm*—Beveridge, DeGrandi, Weilacher & Young, LLP

[57] ABSTRACT

This invention concerns a collapsible container, whose outer profile is shaped to fit the walls of an aircraft luggage compartment, consisting of a rigid base frame supporting an accordion folding frame and whose sides are covered by sheet plate and sections of sturdy canvas.

13 Claims, 6 Drawing Sheets

COLLAPSIBLE AIRCRAFT CONTAINER

This patent application for a utility invention concerns a collapsible aircraft baggage compartment container.

Special containers are used on aircrafts for storing fragile parcels containing breakable or perishable goods, or for storing passenger luggage.

Due to the limited space available in aircrafts, the shape of these containers is generally designed to fit the shape of the walls of the aircraft luggage compartment.

This makes it possible to fully exploit the space available for transport in the aircraft.

These containers are structured like large irregular shaped boxes designed to fit the storage hold and consist of a supporting metal frame and walls covered with sheet plate and/or strong waterproof canvas.

These boxes are quite practical even though they do have one very serious inconvenience.

It is acceptable that when the containers are filled with parcels or luggage they will take up a considerable amount of room in the aircraft hold, but less so when the parcels and luggage have been unloaded and the containers travel empty in the hold.

It often happens that when there are empty luggage containers in the hold it becomes impossible to load additional containers of the same type.

The purpose of this invention is to design an aircraft container which when empty may be folded down to one third of its standing height.

Thanks to this feature, it is possible to stack three empty folded containers in a space that would normally be used for one fully loaded container.

From a practical point of view, this feature is extremely advantageous in that thanks to the saving in space given by the item according to the invention it is possible to load additional containers filled with parcels and luggage or stacks of three folded empty containers.

Therefore, in one aspect of the present invention, the inventive collapsible container includes a slanted rear base frame and a front base frame spatially supported from the slanted rear base frame. Further, a front intermediate frame is pivotally coupled to the front base frame, and a rear intermediate frame is pivotally coupled to the slanted rear base frame. Pivotally coupled to the front intermediate frame is a front upper frame and pivotally coupled to the rear intermediate frame is a rear upper frame. A locking means for releasably locking the front and rear intermediate frames and the front and rear upper frames in both a working position and a folded position is also included so that the collapsible container is collapsible from the working position to the folded position.

For major clarity, the description of the invention continues with reference to the enclosed drawings intended for purposes of illustration and not in a limiting sense, whereby:

Figure 11:
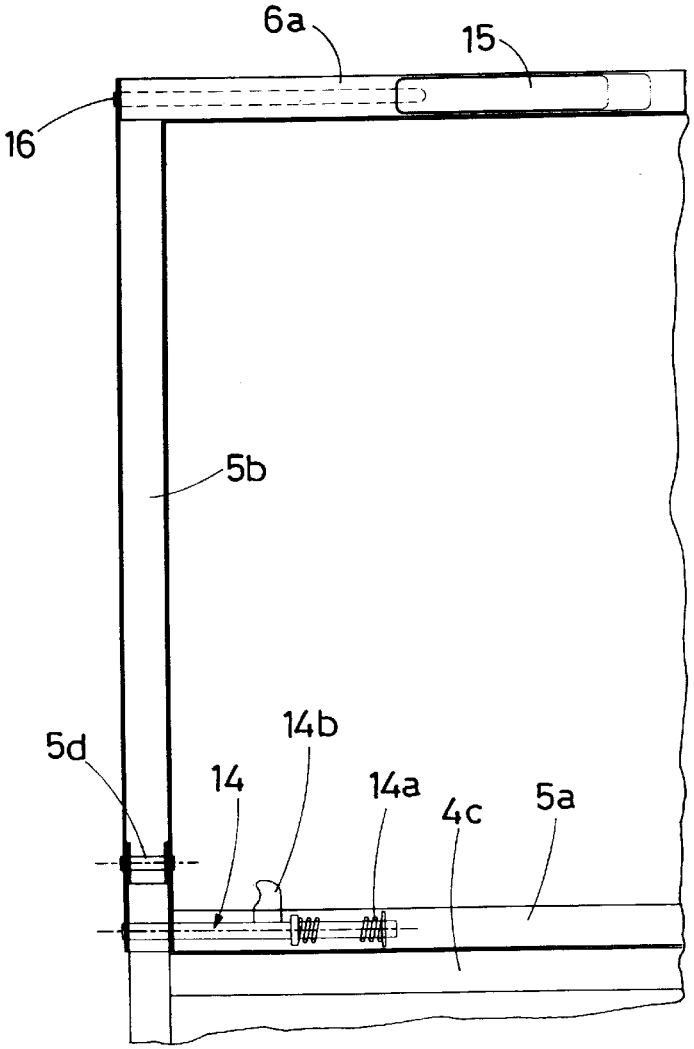

FIG. 11 refers in particular to one of the bolts used to fix the sides of the container into its working position.

With reference to the enclosed drawings, the container (1) according to the invention in the preferred embodiment consists of a supporting and stabilizing base (2) from which a framework made of section steel, projects.

The container illustrated in the enclosed drawings consists of a large parallelepiped box having a rounded rear bottom corner in order to adapt to the shape of the walls of an aircraft hold; this does not however prevent containers with different shapes from being realized according the to same inventive principle. Above the stabilizing base (2) there being provided for about one third of the height of the container (1) a rigid tank-like framework with a rectangular frame (3*a*) positioned vertically and connected by means of a pair of longitudinal elements (3*b*) to a second and higher rectangular frame (3*c*) slanting outwards and whose uprights delimit the rounded outer corner of the container in question.

The stability of the connection between the two longitudinal elements (3*b*) and the slanted frame (3*c*) is ensured by two upside down "L" shaped brackets (3*d*) that connect the ends of the longitudinal elements (3*b*) to the top of the uprights of the slanted frame (3*c*).

The actual folding structure being supported above this rigid tank-like structure; said folding structure consisting of two opposing pairs of identical rectangular frames (4 and 5) designed to realize the opposing sides of the container in question.

Figure 1:
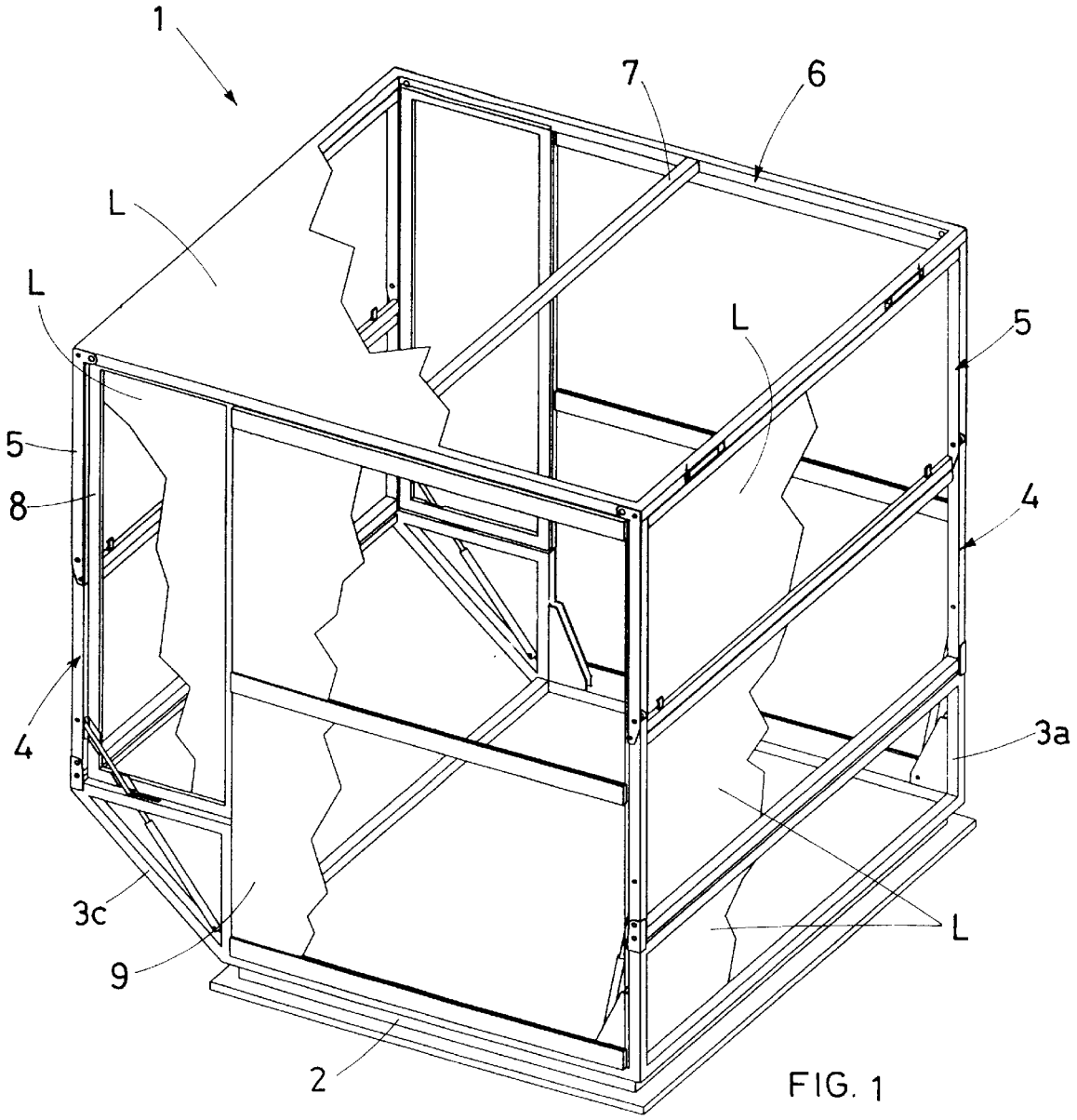
FIG. 1 is a drawing of the container according to the invention in its working position.

In fact, when the container is in working position—as shown in FIG. 1—two of the frames (4 and 5) are positioned vertically on the same plane of the above vertical frame (3*a*) while the other two frames (4 and 5) are placed in the same position above the top cross member of the slanted frame (3*c*).

In particular, each of said frames (4 and 5) consists of a base cross member (4*a* and 5*a*), two short uprights (4*b* and 5*b*) and a second cross member (4*c* and 5*c*) fitted at a slightly lower level with respect to the top of the uprights themselves.

In order to allow the container according to the invention to fold, the two opposing frames (4) positioned at an intermediate level on the sides of the container, are pivoted on the base, with respect to the pairs of horizontal pins (4*d*), to the two fixed frames (3*a* and 3*c*) which form the rigid base framework, while the two opposing top frames (5) are pivoted on the base, again with respect to the pairs of horizontal pins (5*d*) to the frames (4) below.

Figure 6:
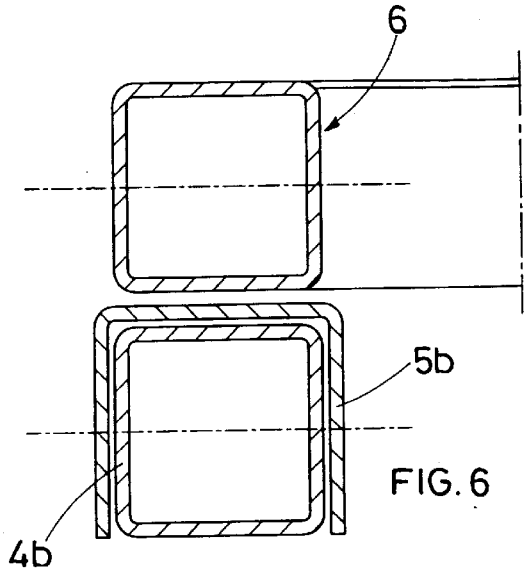
FIG. 6 is a cross-section of FIG. 5 showing plane VI—VI.

It is worth mentioning that the two frames (4) positioned at an intermediate level are provided with uprights (4*b*) realized with square metal section steel, similar to those used to realize the rigid tank-like structure, while the two top frames (5) are provided with uprights (5*b*) realized in transverse channel section steel, sized to hold the metal square section steel in which the two intermediate frames (4) are realized, as shown in FIG. 6.

The two opposing top frames (5) are hinged at the top with respect to horizontal pins (5*e*) which fit into special pairs of eyelets (5*f*), at the ends of the cross members (6*a*) of a rectangular frame (6) which delimits the container at the top.

It is in fact a frame positioned horizontally and consisting of four metal section steel bars having runners (6*b*) connected by means of a central reinforcing cross-member (7).

All the above frames (3*a*, 3*c*, 4 and 5) which form the sides of the container are covered, in the preferred embodiment, by means of thin sheet plate (L), also used for the top horizontal frame (6); the front and rear opening of said container being covered with a combination of sheet plate and canvas.

In particular, two additional rectangular frames (8) being pivoted above the horizontal wing of the "L" shaped brackets (3*d*) supporting the slanted frame (3*c*), said frames (8) being positioned heightwise and covered with thin sheet plate (L).

Next to said frames (8), two wide canvas sheets (9) are provided to cover the entire height of the container and which are suspended indirectly from cross-member (7), each being reinforced by means of three metal bars (10), the first being applied at the top, the second at the center and the third at the base.

Figure 2:
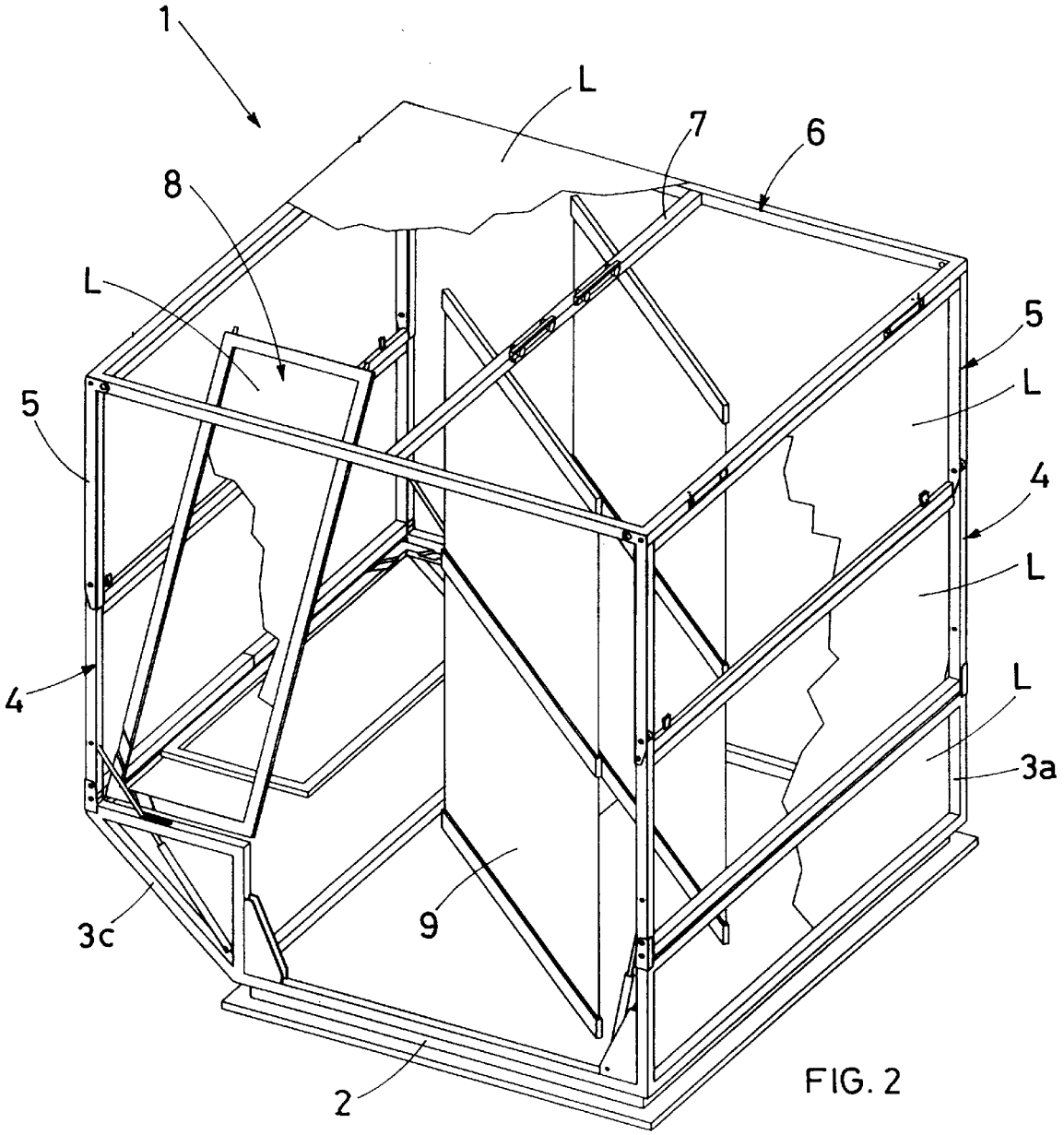
FIG. 2 is a drawing of the container according to the invention showing the first closing phase of the container.
Figure 3:
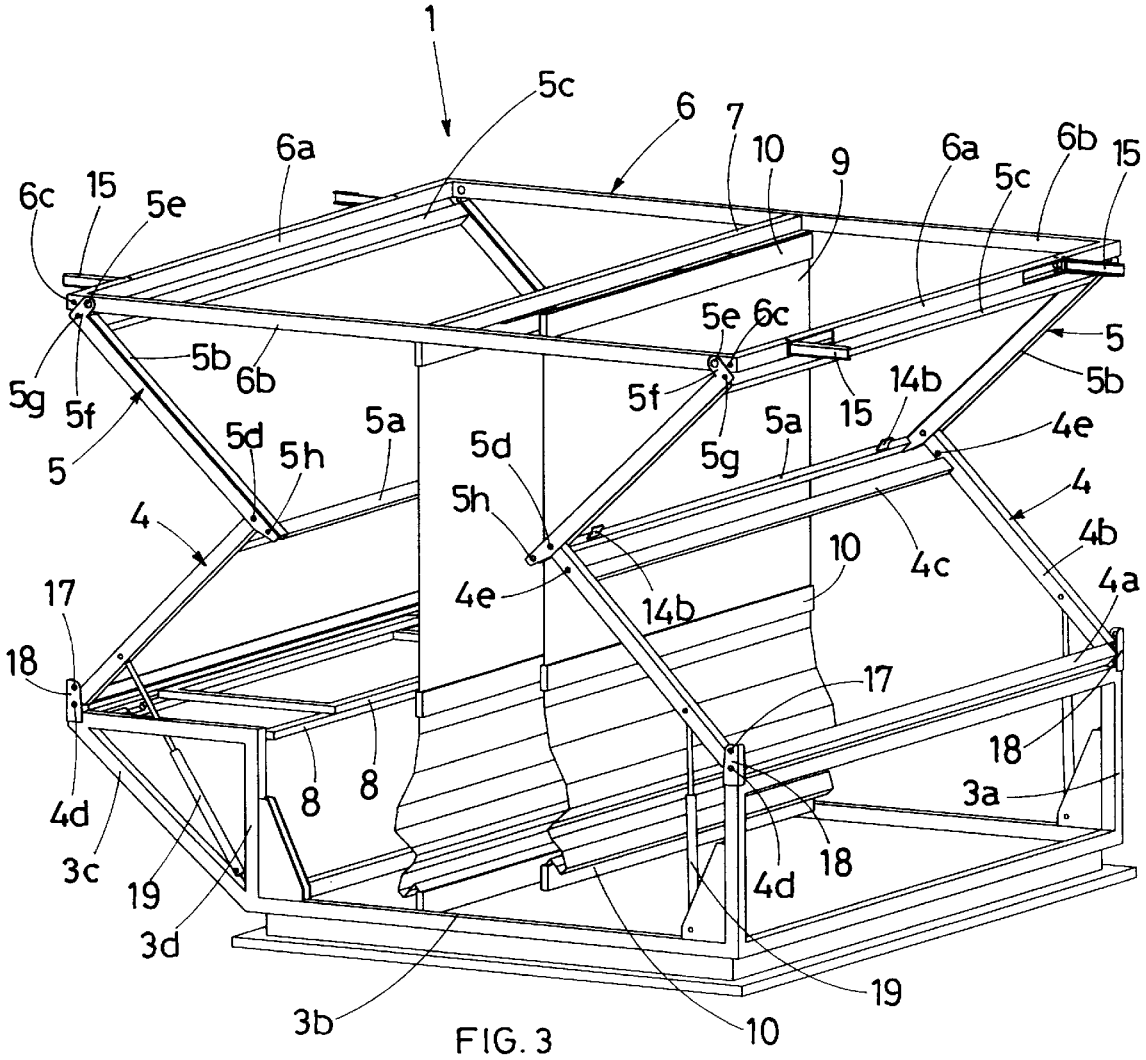
FIG. 3 is a drawing of the container according to the invention showing a more advanced closing stage of the container.

As far as the method of folding the container is concerned, firstly the two frames (8) pivoted on the two supporting brackets (3*d*) must be tipped inwards into a horizontal position one on top of the other; at the same time the two side sheets (9) can be pulled backwards towards the interior, as shown in FIGS. 2 and 3.

This backward translation of the canvas sheets (9) is possible thanks to the fact that on the back of the bar (10) fitted at their tops, a bushing (11) is provided which revolves with respect to a pin (12) having a vertical axis fitted on a rack (13) sliding longitudinally inside the cross-member (7) which connects the two runners (6*b*) of the rectangular frame (6) delimiting the container at the top.

In particular, this rack (13) consists of a metal plate (13*a*) positioned edgewise, having two pairs of wheels with horizontal axis (13*b*) at the ends; while said wheels (13*b*) slide in the cross-member (7) which houses the same, the bottom element of the plate (13*a*), namely the one that at the end supports pin (12), projects from cross-member (7) through the middle longitudinal slot (7*a*) which ensures that the same is free to slide alternatively.

When said sheets (9) are drawn back towards the centre of the cross-member (7), by exploiting the sliding capacity of the relevant racks (13), they can be rotated 90° around the vertical pins (12) until they are drawn together, parallel to that of the cross-member (7) (see FIG. 3).

The next step consists of "pressing down" the folding structure of the container in question, namely that consisting substantially of the two opposing pairs of frames (4 and 5).

For this purpose it is necessary to release firstly the mechanisms which keep the two pairs of overlying frames (4 and 5) aligned vertically and then the mechanisms which join the top horizontal frame (6) with the opposing top frames (5), as detailed in the sequel of the description.

These two releasing steps are in fact carried out firstly on the four bolts (14) fitted on the bottom cross-members (5*a*) of the top frames (5) and then on the two pairs of horizontal rods (16) operated by relevant handles (15) fitted to the outer face of the cross-members (6*a*) of the top frame (6).

Once said mechanisms have been released, the top horizontal framework (6) is drawn down gradually due to the accordion closing of the two pairs of frames (4 and 5) toward the interior of the container, as shown in FIG. 3.

Figure 4:
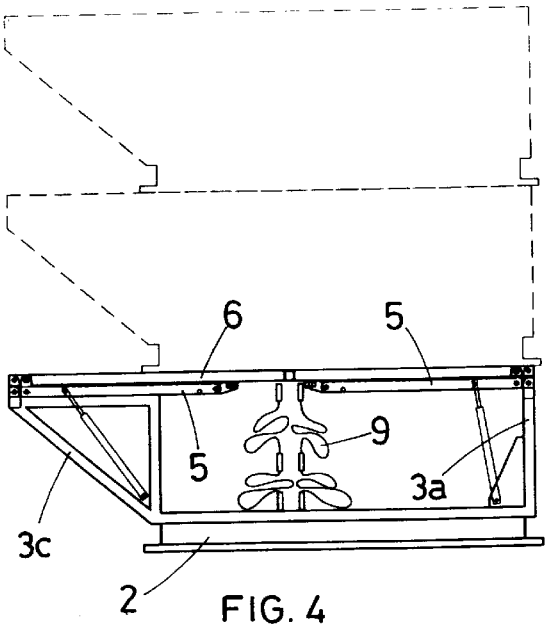
FIG. 4 is a side view of the folded container.
Figure 5:
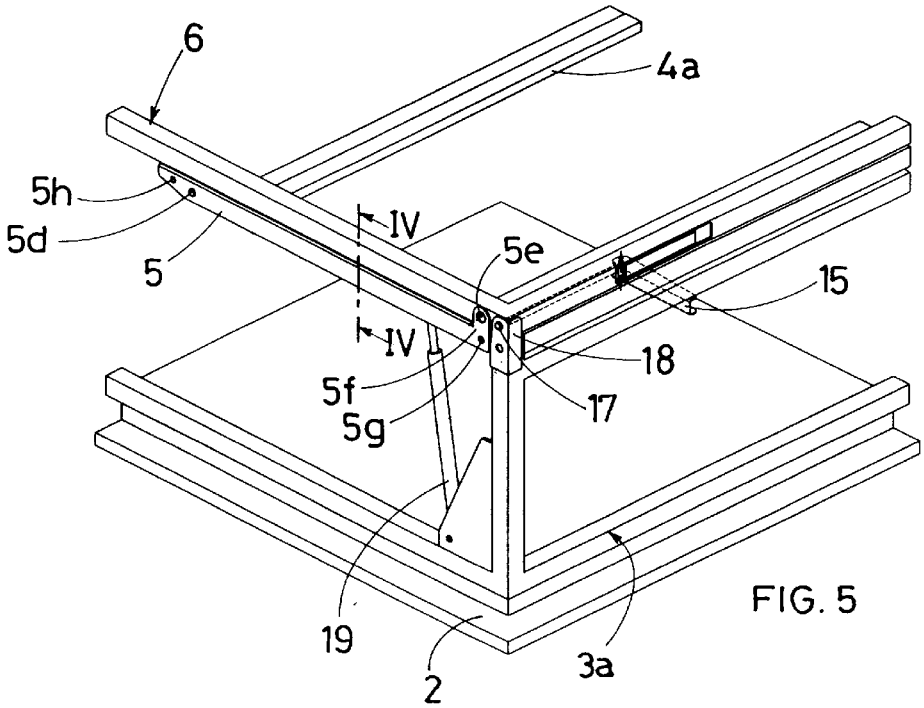
FIG. 5 is a drawing of a corner of the folded container.
Figure 7:
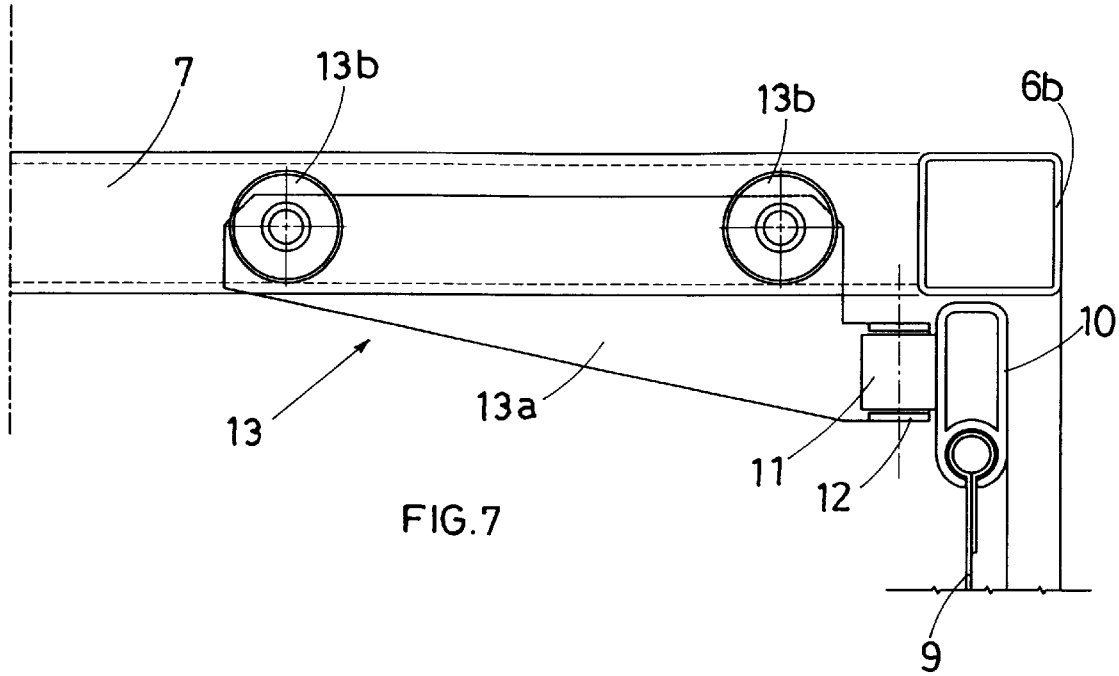
FIG. 7 is a side view of the supporting rack for one of the canvas sheets of the container.
Figure 8:
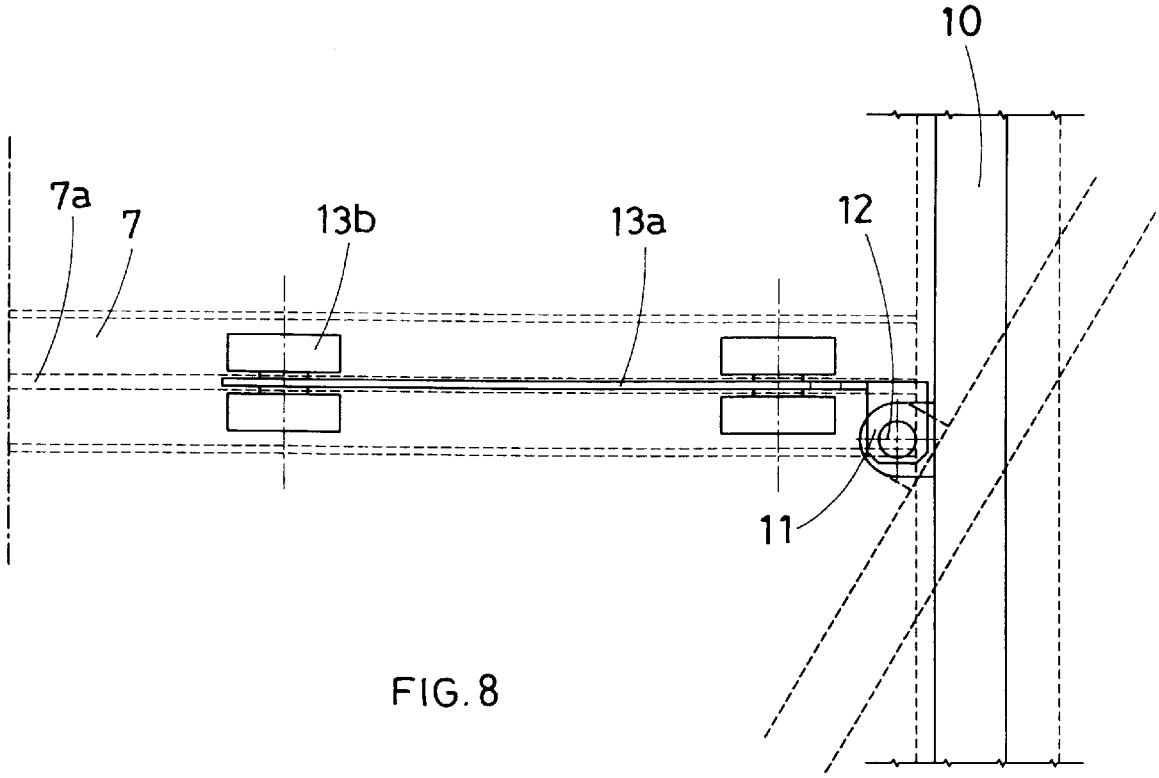
FIG. 8 is a top view of FIG. 7.

As shown in FIGS. 4 and 5, after this step, the two middle frames (4) are horizontal, while above these, the top frames (5) draw together and in turn are in contact with the bottom face of the rectangular frame (6) which delimits the top part of the container.

FIG. 6 shows that when the folding part of the container "is pressed", the channel uprights (5*b*) of the top frames (5) are clasped together incorporating in this way the square section steel uprights (4*b*) of the underlying frames (4).

It is this very feature which is determining in reducing the height of the container when folded to exactly one third of its normal height.

Figure 9:
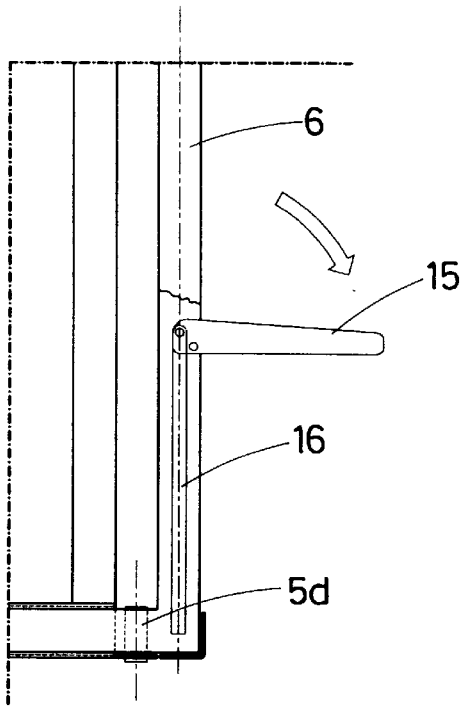
FIGS. 9 and 10 show one of the mechanisms used to fix and release the sides of the container according to the invention into the two possible working positions.
Figure 10:
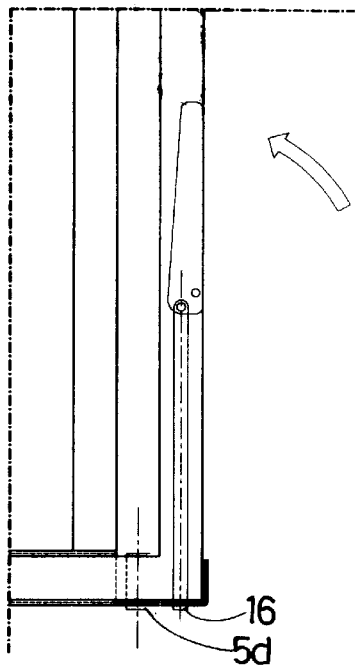

Regarding the mechanisms which make it possible to fold the two pairs of folding accordion frames (4 and 5), it should be noted, as shown in FIGS. 9 and 10, that a first series of these is provided at the top of the container (1) in question. Each of these special mechanisms consists substantially of a rod (16) which is housed and slides in the cross-member (6*a*) of the horizontal frame (6), whose rear end is pivoted eccentrically at the base of the relevant handle (15), while its sharp front end faces a hole (6*c*) provided at the end of the cross-member (6*a*).

When the container is in working position, the sharp ends of the four rods (16) must fit into the holes (5*g*) provided at the top of the uprights of the top frames (5).

In order to fold the container, it is necessary to release these sharp ends from said holes (5*g*), by operating the relevant handles (15) to draw back the rods (16).

Once the container has been "pressed down", the rods (16) lock the container into its compacted position; to do this, it is necessary to action the handles (15) again so that the sharp end of each rod (16) returns into a projecting position and fits into a hole (17) provided for this purpose on an angular plate (18) provided at the top of each upright of the two fixed frames (3*a* and 3*c*) which are an integral part of the rigid base tank-like structure.

In this regard, it should be noted that on said plates (18), just below holes (17), a series of holes are provided for the horizontal hinging pins (4*d*) for the frames (4).

With reference to FIG. 11, the second series of mechanisms which enable the container (1) in question to maintain its working position, consists of four bolts (14) each of which is fitted and slides within a terminal section of one of the bottom cross-members (5*a*) of the top frames (5).

In particular, each of said bolts (14) undergoes the thrust of a pre compressed helicoidal spring (14*a*) which tends to keep the sharp end in a projecting position through a hole provided at the end of the cross-member (5*a*) which houses it. Thus, when the container (1) is in operating position, said bolts (14) are used to keep the top ends of the uprights (4*b*) of the middle frames (4) integral with the bottom ends of the uprights (5*b*) of the top frames (5).

For this purpose, the sharp end of each bolt (14)—thanks to the thrust of the relevant spring (14*a*)—penetrates automatically and simultaneously into a hole having a horizontal axis (4*e*) provided at the top of the upright of one of the middle frames (4) and into the hole (5*h*) provided at the base of the external edge of the channel section of which the upright (5*b*) of the top frame (5) is realised.

This simultaneous housing of the bolt (14) into the two aligned holes (4*e* and 5*h*) is possible in that the channel section with which the upright (5*b*) of the top frame (5) is realized, has a "C" cross-section which enables it to encircle the square section steel with which the upright (4*b*) of the middle frame (4) is realised.

When, on the other hand, it is necessary to fold the container (1), it is obviously necessary to draw back and release the sharp end of each bolt from the two holes provided on the uprights (4*b* and 5*b*) of the frames (4 and 5); in order to carry out this step easily, the rod of each bolt (14) is provided with a nib (14*b*) which projects upwards and which slides through a shaped slot provided on the upper face of the cross-member (5*a*) housing the corresponding bolt (14).

It is obvious that during this operation, after drawing back the bolt (14) by means of said nib (14*a*), it is necessary to lock the latter securely into its rear end-of-run position, namely that whereby its sharp end remains fully housed within the cross-member (5*a*) of the frame (5) which houses it.

In particular, the secure locking of the bolt (14)—which obviously opposes the thrust of the pre compressed spring (14*a*)—may be achieved by means of a tooth provided for this purpose on the shaped slot in which the nib (14*b*) slides.

Finally, the number (19) refers to several hydraulic jacks which act as shock absorbers and are fitted between the fixed and folding sections of the tubular structure of the container in question; their function is to make the folding and lifting action of the folding structure above the base fixed structure, smoother.

What is claimed is:

1. A collapsible container, comprising:

a slanted rear base frame;

a front base frame spatially supported from said slanted rear base frame;

a front intermediate frame pivotally coupled to said front base frame;

a rear intermediate frame pivotally coupled to said slanted rear base frame;

a front upper frame pivotally coupled to said front intermediate frame;

a rear upper frame pivotally coupled to said rear intermediate frame, wherein said front and rear intermediate frames and said front and rear upper frames are movable from an upright position to rest respectively upon said front and rear base frames;

locking means for releasably locking said front and rear intermediate frames and said front and rear upper frames in a working position and in a folded position such that said collapsible container is collapsible from said working position to said folded position.

2. The collapsible container defined by claim 1, wherein:

said front intermediate and said front upper frames are disposed opposite said rear intermediate and said rear upper frames, respectively, in said working position.

3. The collapsible container defined by claim 1, further comprising:

a top frame pivotally coupled to said front upper frame and said rear upper frame.

4. The collapsible container defined by claim 1, wherein:

said upper frames and said lower frames are essentially equal in height.

5. The collapsible container defined by claim 1, wherein:

said front and rear intermediate frames and said front and rear upper frames are folded in a folded position.

6. The collapsible container defined by claim 5, wherein:

said container in said folded position has a height approximately one third a height of said container in said working position.

7. The collapsible container defined by claim 1, further comprising:

a pair of side members;

a top frame pivotally coupled to said front upper frame and said rear upper frame, said top frame including a top frame cross support member; and means for slidably and pivotally coupling said side members to said top frame cross support member.

8. The collapsible container defined by claim 7, further comprising:

a pair of flexible sheet members, each flexible sheet member being engaged with one of said side members.

9. The collapsible container defined by claim 7, further comprising:

a pair of side frames, said side frames each being respectively disposed in an area defined adjacent to said rear intermediate frame, said rear upper frame and said top frame, and means for releasably coupling each side frame in said area, respectively.

10. The collapsible container as defined in claim 9, wherein:

said front intermediate and said front upper frames are disposed opposite said rear intermediate and said rear upper frames, respectively, in said working position, and said front and rear upper frames and said front and rear lower frames are essentially equal in height.

11. A collapsible container, comprising:

a slanted rear base frame;

a front base frame spatially supported from said slanted rear base frame;

a front intermediate frame pivotally coupled to said front base frame;

a rear intermediate frame pivotally coupled to said slanted rear base frame;

a front upper frame pivotally coupled to said front intermediate frame;

a rear upper frame pivotally coupled to said rear intermediate frame, wherein said front and rear intermediate frames and said front and rear upper frames are movable from an upright position to rest respectively upon said front and rear base frames; and locking means for releasably locking said front and rear intermediate frames and said front and rear upper frames in a working position, wherein said front and rear intermediate frames and said front and rear upper frames are folded in a folded position so as to be collapsible from said working position, said container in said folded position has a height approximately one third a height of said container in said working position, and said front and rear upper frames each include upright members each having a channel defined thereby, upright members of each of said front and rear intermediate frames being received in said channel, respectively, in said folded position.

12. The collapsible container defined by claim 11, further comprising:

means for providing support to at least one of said front and rear intermediate frames when in a position between said locked and said folded positions.

13. The collapsible container defined by claim 11, further comprising:

a top frame pivotally coupled to said front upper frame and said rear upper frame, wherein said front and rear upper frames and said front and rear intermediate frames are essentially equal in height, and said locking means is further for locking said front and rear intermediate frames and said front and rear upper frames in said folded position.

* * * * *

UNITED STATES PATENT AND TRADEMARK OFFICE

CERTIFICATE OF CORRECTION

PATENT NO. : 5,890,612

DATED : April 6, 1999

INVENTOR(S) : Paolo Coppi

It is certified that error appears in the above-indentified patent and that said Letters Patent is hereby corrected as shown below:

On the title page, correct [73] Assignee: Penang Holding N.V., Curacao, Netherlands, Antilles.

Signed and Sealed this

Twenty-first Day of December, 1999

*Attest:*

Q. TODD DICKINSON

*Attesting Officer*

*Acting Commissioner of Patents and Trademarks*